US005443084A

United States Patent [19]

Saleur

[11] Patent Number: 5,443,084

[45] Date of Patent: Aug. 22, 1995

[54] PAPER MOISTENER DEVICE AND MOIST TOILET PAPER DISPENSER

[76] Inventor: Rémy Saleur, 12, Place Vauban, 89200 Avallon, France

[21] Appl. No.: 146,024

[22] PCT Filed: May 7, 1991

[86] PCT No.: PCT/FR91/00377

§ 371 Date: Jan. 5, 1994

§ 102(e) Date: Jan. 5, 1994

[87] PCT Pub. No.: WO92/19141

PCT Pub. Date: Nov. 12, 1992

[51] Int. Cl.[6] ..... B08B 3/2

[52] U.S. Cl. ..... 134/58 R; 134/198; 134/201; 134/122 R

[58] Field of Search ..... 134/198, 201, 57 R, 134/56 R, 58 R, 201, 69 R, 122 R, 197; 15/104.94; 118/325, 234

[56] References Cited

U.S. PATENT DOCUMENTS

| | | | |
|---|---|---|---|
| 3,707,945 | 1/1973 | Boone . | |
| 3,749,313 | 7/1973 | Weitmann | 118/326 |
| 3,804,061 | 4/1974 | Cassar et al. | 118/325 |
| 3,848,822 | 11/1974 | Boone . | |
| 4,620,502 | 11/1986 | Kimble . | |
| 4,667,846 | 5/1987 | Marceau . | |
| 4,798,312 | 1/1989 | Scheiber . | |
| 4,947,026 | 8/1990 | Groom et al. . | |
| 5,031,258 | 7/1991 | Shaw . | |

FOREIGN PATENT DOCUMENTS

| | | |
|---|---|---|
| 3409905 | 9/1985 | Germany . |
| 8804150 | 6/1988 | WIPO . |

*Primary Examiner*—Frankie L. Stinson
*Attorney, Agent, or Firm*—Jacobson, Price, Holman & Stern

[57] ABSTRACT

The invention relates to a humidifying device for hygienic articles such as toilet paper, sanitary towels, etc. and a dispenser of humidified hygienic articles. The aim of the invention is to provide a humidifying device which is usable alone or in a housing or integrated in a distributor of hygienic articles (40). This is achieved by the disclosed humidifying device which is comprised of a refill (2) consisting of a reservoir (3) which has been previously fitted with a vaporization pump (4), and a means for actuating said pump, characterized in that said actuation means is of the electric type and forms with the refill (2) an interchangeable electric assembly (6). The invention applies more particularly to humidified toilet paper dispensers.

17 Claims, 4 Drawing Sheets

PAPER MOISTENER DEVICE AND MOIST TOILET PAPER DISPENSER

The present invention concerns a paper moistener device more particularly intended for use in a toilet paper or sanitary towel dispenser.

For reasons of hygiene and personal comfort, some persons wish to be able to carry out an intimate toilette or to use deodorized sanitary towels, for example. Other persons suffering or having suffered from various anorectal or perianal infections wish to use antiseptic and/or soothing toilet paper or sanitary towels to prevent the infection breaking out again or to avoid further irritation which may aggravate the discomfort or the existing infection.

To this end numerous toilet paper dispensers with an integral moistener system have been proposed. Most comprise a casing adapted to be fixed to a vertical wall and one part of which contains the toilet paper or sanitary towels and another part of which accommodates the moistener system which usually comprises a reservoir for water or some other liquid, in the form of a refillable bottle, for example, either on its own or in combination with an open container, and means for moistening the sheet of toilet paper. There are two known ways to moisten the paper:

the first is to moisten the paper by dipping it into an open container of the water or other liquid, as described in the patents FR n° 1 462 232, FR n° 2 238 457 and EP n° 0 219 981. In this case the toilet paper is fed from a roll around a single mobile drum or between two drums mobile conjointly and disposed above the open container of liquid. The user lowers said drum or drums using means provided for this purpose and then pulls out the required length of paper; this is then moistened by the liquid absorbed onto the surface of the drum rotating in the full container.

Unfortunately, when the user pulls on the moistened paper there is a considerable risk of the paper tearing prematurely or inside the dispenser casing. Apart from this major drawback the paper may be excessively or insufficiently moistened, depending on the impregnation time, i.e. on the speed with which the user pulls off the paper. Finally, it is often difficult to lower the drum correctly as appropriate to the level of liquid in the open container.

the second way is to spray water or another liquid onto the toilet paper or sanitary towels. According to the patent FR n° 1 528 715 the user pulls out the required length of paper from the roll and simultaneously exerts repeated pressure on a piston projecting from the casing. The piston operates a mechanical pump connected to the bottle containing the water. A sprayer system inside the casing then sprays the water. In this case the user faces the same problem as that already mentioned, namely the risk of tearing when he pulls on the moistened paper. According to the patents FR n° 1 236 258 and FR n° 1 237 556 the user first takes the toilet paper and then places it in front of the spraying system. He then applies repeated mechanical pressure to the flexible walls of the sprayer bottle or to the piston of a mechanical pump fitted to the bottle containing the liquid. Dispensers are also known in which a spraying system is placed directly above the supply of toilet paper or sanitary towels, as described in the patents FR n° 2 002 174 and 2 554 700.

The major drawback of these latter devices is that several layers of paper or sanitary towels are impregnated simultaneously. This is costly and wasteful since the quantity moistened often exceeds what the user needs. The consequence is high consumption of paper or sanitary towels and some unpleasantness for the next user.

Also, the spraying systems tend to become soiled and they must be cleaned frequency to prevent them clogging.

Finally it may be generally remarked that all the proposed dispensers require multiple operations of the user which are inconvenient to a greater or lesser degree.

The present invention remedies the drawbacks explained hereinabove by offering the user a moistening system that can be used on its own in a casing or integrated into a dispenser of hygiene items, for example, that is of low cost, that is very simple and agreeable to use and that does not have any particular maintenance requirements.

To this end, the present invention consists in a moistener device intended for example to be used in a toilet paper dispenser comprising a refill comprising a reservoir fitted beforehand with a spray pump and pump actuator means, characterized in that the actuator means are electrical and with the refill constitute an interchangeable electrical system.

In one embodiment of the invention the interchangeable electrical system comprises a support frame provided with a set of units disposed to reduce the overall size and connected to an electrical power supply and comprising a refill, a photo-electric cell disposed near the spray holes of the pump to sense the hand of the user or the toilet paper or sanitary towel that the user is holding, a solenoid which operates on a lever pivoting about an axis on the support frame and the arm of which actuates the pump, movement of said lever being damped by a damper system.

In one embodiment the interchangeable electrical system comprises a support frame comprising a set of units disposed to reduce the overall size and connected to an electrical power supply and including a refill, a switch disposed on a wall of the support frame so that it is accessible to the user and connected to a motor-gearbox to operate via a cam rotating on a shaft a lever pivoting about an axis and the arm of which operates the pump.

The moistener device in accordance with the present invention may advantageously be integrated into a casing forming a dispenser of hygiene items such as toilet paper, sanitary towels, etc.

In a preferred embodiment of the invention said dispenser comprises at least one moistener device, at least one supply of toilet paper, a paper guiding and cutting system, a paper detector and a guide plate for controlling unrolling of the paper automatically.

The invention will now be described in more detail by way of illustrative and non-limiting example with reference to the appended drawings in which.

Figure 1:
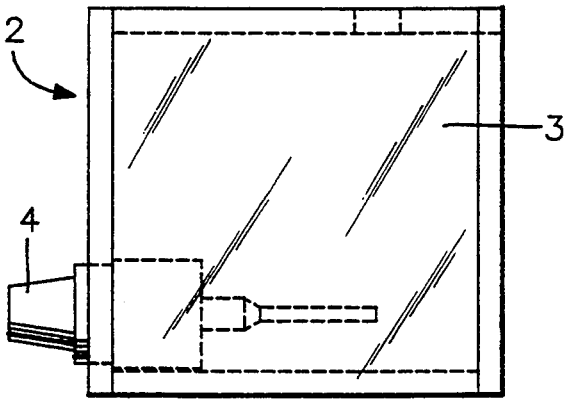
FIG. 1 is a diagrammatic side view of one embodiment of a refill for a moistener device, in accordance with the invention.

The present invention consists in a moistener device 1 comprising a refill 2 including a reservoir 3 equipped with a pump 4 and means of actuating said pump. The reservoir 3 may be made from transparent or opaque plastics material or glass. It may be round or parallelepiped shape (as in the example shown in FIG. 1) to suit the shape and size of the housing in which it is to be placed. Its capacity is variable. As shown in FIG. 1 the reservoir 3 is provided with a conventional pump 4, for example a spray pump. The pump 4 may be screwed to the reservoir 3 so that it may be refilled. However, in the case of antiseptic solutions, for example, the pump 4 is preferably crimped to the reservoir 3 so that it cannot be refilled; this avoids any risk of contamination.

The refill 2 may be marketed ready to use in supermarkets or any other kind of store distributing hygiene products.

This has the advantage of eliminating the cleaning of the reservoir or the spraying system characteristic of the prior art devices. The device in accordance with the invention is accordingly simple to use and imposes no particular constraints upon the user.

The reservoir contains scented or unscented water, an antiseptic solution or a medicated solution, depending on the intended use of the moistener device in accordance with the invention, intimate toilette, disinfecting or soothing, for example.

The pump 4 is operated electrically.

Figure 2:
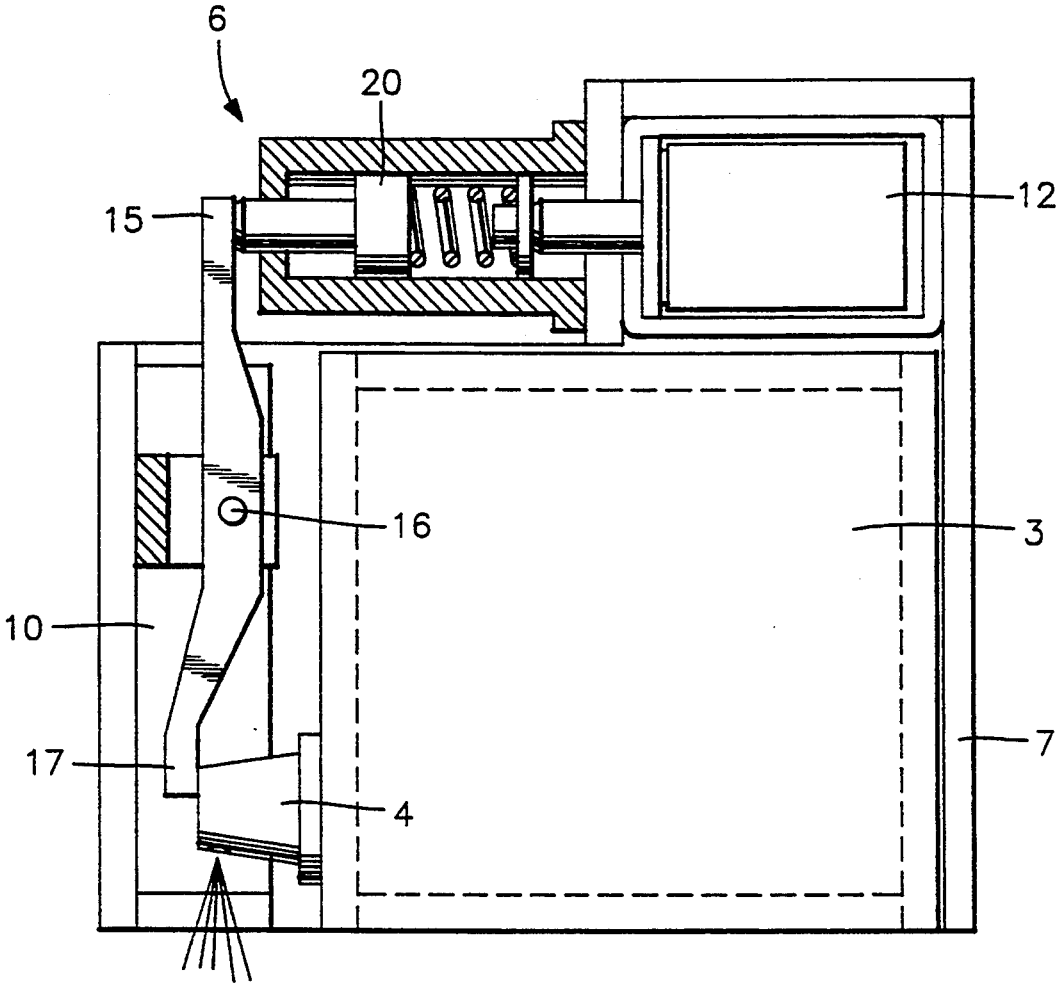
FIG. 2 is a diagrammatic view in cross-section of an interchangeable electrical system in accordance with the invention.
Figure 3:
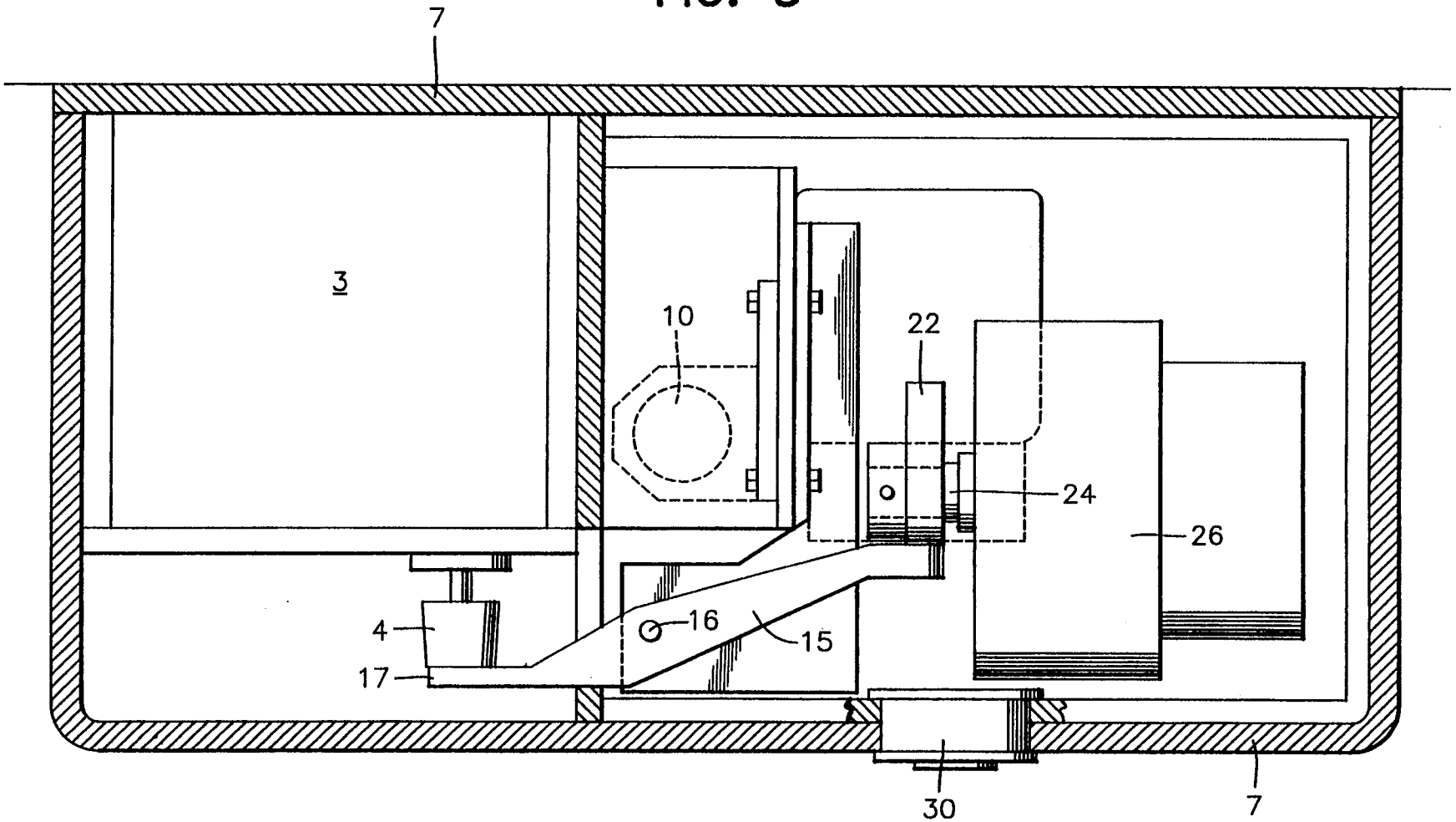
FIG. 3 is a diagrammatic view in cross-section of another embodiment of an interchangeable electrical system in accordance with the invention.

FIG. 2 shows the moistener device provided with electric actuator means. It is in the form of an interchangeable electrical system 6 into which the refill 2 slides. The interchangeable electrical system 6 comprises a support frame 7 carrying a set of units which are judiciously disposed in said support frame to reduce the overall size. The support frame 7 preferably comprises a mobile (for example, hinged) wall to enable the insertion or the replacement of the refill 2. The set of units comprises a photo-electric cell 10, a solenoid 12, a lever 15 and a damper system 20. The support frame 7 therefore has an opening under the pump 4 for the spray to exit and two other openings for convenient disposition of the damper system 20 and the lever 15, as shown in FIG. 2. The photo-electric cell 10 is disposed near the spray holes. The solenoid 12 operates the lever 15 which pivots about an axis 16 and whose arm 17 operates the pump 4. When the photoelectric cell 10 senses the hand of the user holding a sheet of toilet paper or a sanitary towel it causes the solenoid 12 to pivot the lever 15. Pivoting of the lever is damped by the damper system 20. As a result the user obtains a fine spray. In one embodiment (shown in FIG. 3) the photo-electric cell 10 (shown in dashed outline) may be connected to a motor-gearbox 26 operating the lever 15 which operates the pump 4 through a cam 22 rotating on a shaft 24. This cam system minimizes operating noise.

The photo-electric cell 10 may be replaced by an electric switch 30 (see FIG. 3) placed on a wall of said support frame 7 so that it is readily accessible by the user.

The interchangeable electrical system 10 may be connected direct to the 220 volts supply provided that the statutory regulations in respect of electrical devices in sanitary facilities are complied with. It may instead be connected to a 24 volts supply or battery-operated. To this end the support frame 7 may be provided with connectors (not shown) on its rear surface. Contact is then assured simply by engaging or not said connectors.

The interchangeable system 6 may be housed in a support casing 21. Two embodiments are then feasible: either the support casing 21 is adapted to the dimensions of the interchangeable electrical system 6 and has a mobile lid 22, or the support casing 21 forms a dispenser of hygiene items 40 as described hereinafter, also having a mobile lid 45.

Figure 4:
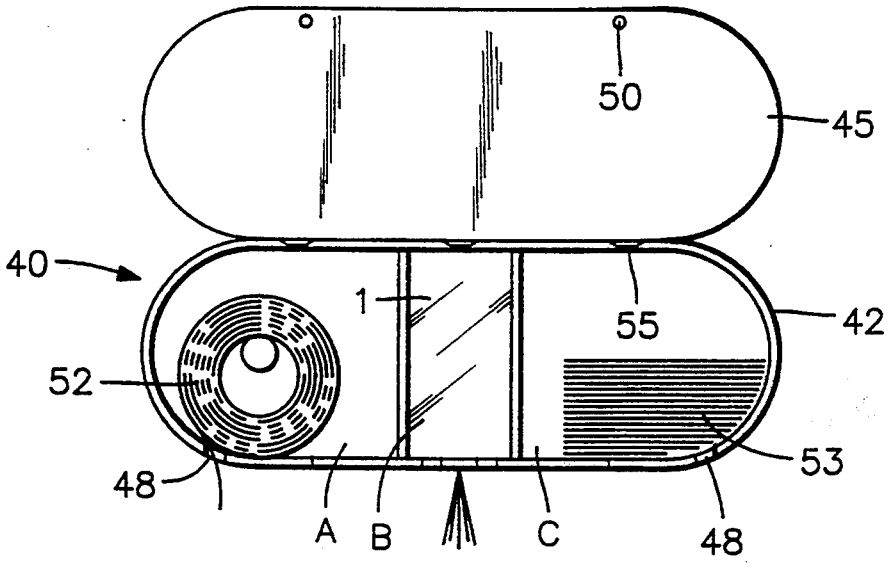
FIG. 4 is a diagrammatic view in cross-section of one embodiment of a dispenser of hygiene items provided with a moistener device in accordance with the invention, shown open.
Figure 5:
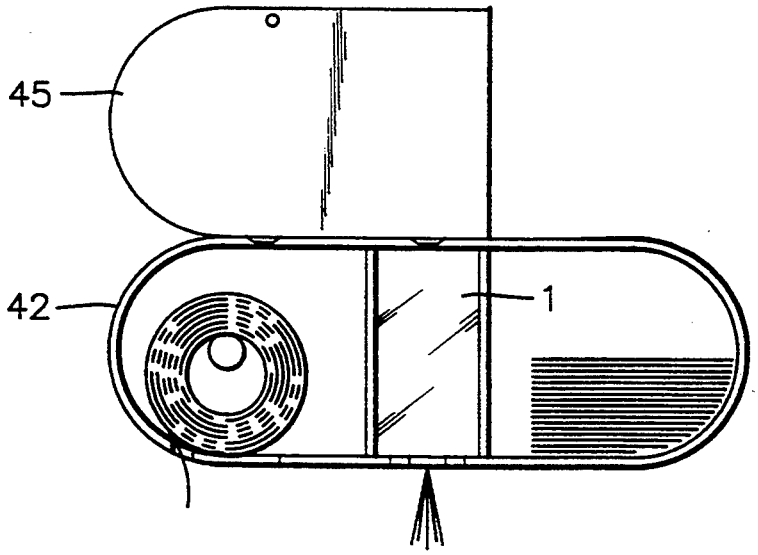
FIG. 5 is a diagrammatic view in cross-section of a second embodiment of a dispenser of hygiene items provided with a moistener device in accordance with the invention, shown open.
Figure 6:
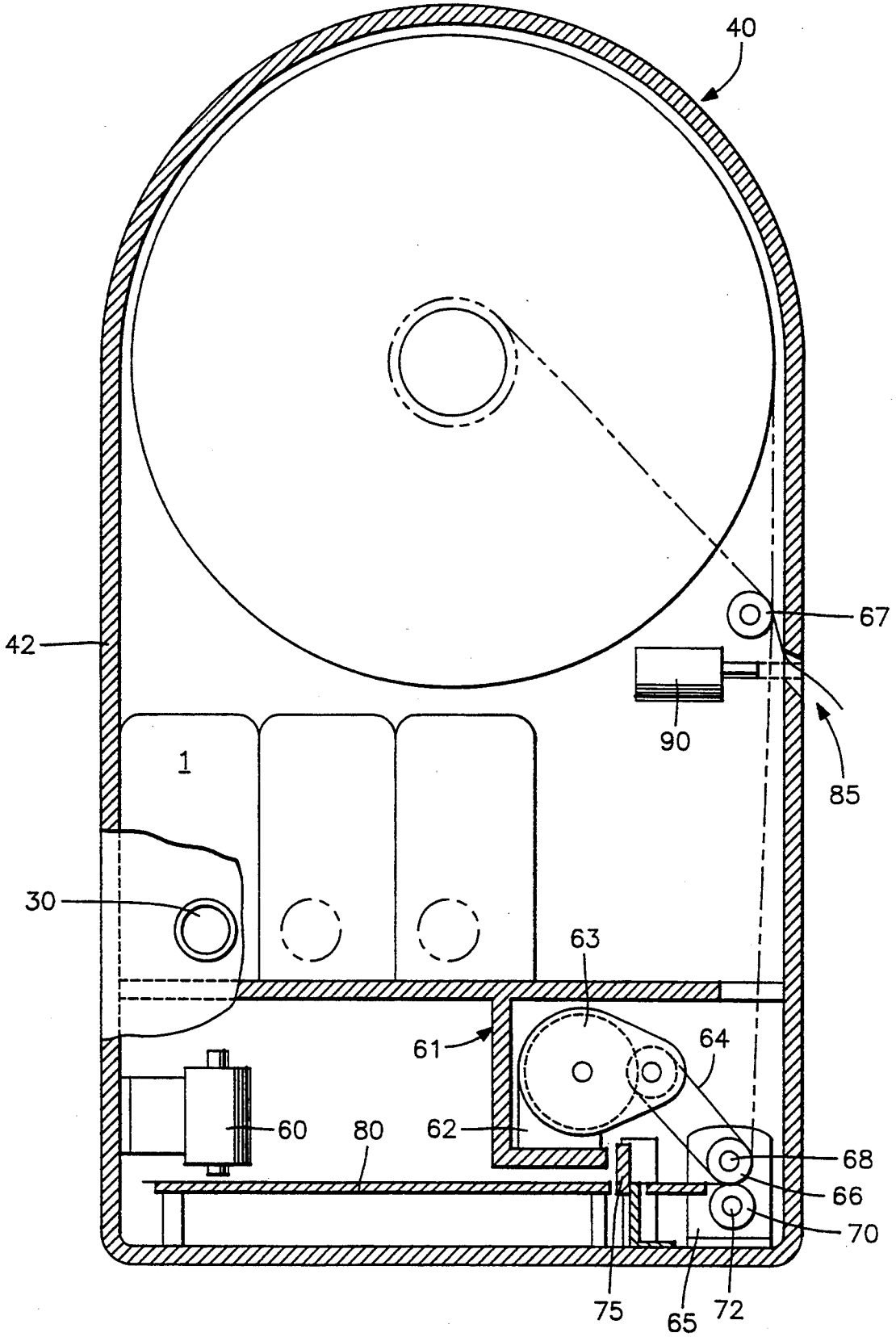
FIG. 6 is a diagrammatic view in cross-section of a third embodiment of a dispenser of toilet paper provided with at least one moistener device in accordance with the invention.

According to the invention, the moistener device 1 may be integrated into a casing forming a dispenser of hygiene items 40 such as toilet paper or sanitary towels, as shown in FIGS. 4, 5 and 6.

In a first embodiment the dispenser 40 comprises a casing 42 with a lid 45 at the front. It may be fixed to any vertical wall such as a bathroom or "WC" wall using screws or double-sided adhesive tape.

The casing 2 may be of various shapes and made from a material such as wood, metal or plastics material.

The lid 45 is hinged to the casing 42 by hinges 55.

The casing is closed by clips 50, for example, a lock or any other means.

The casing 42 includes a compartment for housing at least one removable moistener device 1 and at least one compartment for receiving a supply of paper or other hygiene items. In a preferred embodiment the casing 42 includes three compartments A, B, C of the same or different size, the compartments A and C being adapted to receive a supply of toilet paper, sanitary towels or condoms. The supply of paper may be in the form of a roll 52 or sheets 53. The paper is drawn out through a slot 48 in the casing 42. The user will choose for preference a higher quality non-woven paper which can be moistened without risk of tearing.

As an alternative to this, the dispenser may contain ordinary paper and higher quality paper. This gives the user the choice of dry toilet paper and toilet paper that can be moistened.

The lid 45 may close all of the casing 42 (see FIG. 4) or only part of it (see FIGS. 5 and 6).

The dispenser in accordance with the invention may have a shelf on its upper side.

The moistener device in accordance with the invention may be used with some other embodiment of the dispenser.

For example, it may be used with a toilet paper dispenser as shown in FIG. 6 in which the casing 42 includes a compartment for receiving one or more moistener devices containing different solutions or the same solution for a longer operating time between refills. It may further comprise means for unwinding the paper automatically. These means may comprise a paper guide and cutting system 61 advantageously disposed in a housing 62 under the compartment containing a roll of toilet paper, for example, a paper sensor 60 and a guide plate 80 to guide the paper as it is unrolled. The aforementioned items contained in the housing 62 are advantageously disposed to reduce the overall size. This set of units is also connected to an electrical supply.

The paper guide and cutting system 61 may comprise two adjacent drums, an upper drum 66 rotating on a shaft 68 and a lower drum 70 rotating on a shaft 72, the shafts 68 and 72 being substantially parallel and mounted on a support 65. The paper guide and cutting system 61 further comprises a motor-gearbox 63 which rotates the upper drum 66 by means of a belt or chain 64.

The paper sensor 60 may be a photo-electric cell or any other means such as a contact member . . . It is disposed opposite the paper guide and cutting system 61 at a distance substantially equal to the required length of toilet paper. The paper cutter 75 used is of a conventional type.

The guide plate 80 is disposed between the paper sensor 60 and the paper guide and cutting system 61. This latter end is disposed at a very small distance from the two drums 66, 70. It is perpendicular to the spraying plane and at a height such that the paper can easily rest on top of it as it leaves the passage between the two drums 66 and 70.

When the sensor senses that no paper is present it causes the motor-gearbox to rotate the upper drum 66 via the chain 64. The toilet paper is fed between the two drums 66 and 70, in particular by means of a guide 67. The upper drum 66 drives the lower drum 70 and feeds the paper, which is guided by the guide plate 80 as the drums rotate; the paper is fed automatically until it is under the paper sensor 60.

While the paper is being fed the paper cutter 75 is naturally in the raised position. A slot While the paper is being fed [sic] is advantageously provided in the guide plate 80 in vertical alignment with said paper cutter to provide a passage for the cutter blade.

When the paper sensor senses that paper is present it stops the motor-gearbox 63 and the paper cutter is operated to cut the paper at the required place.

The operator then has the required length of paper to be used dry or moistened by means of a moistener device in accordance with the invention.

In this embodiment it is preferable to use a moistener device in which the interchangeable electrical system 6 is operated by a switch 30.

Moistening is achieved simply by pressing said switch.

The casing 42 may also be provided with a slot 85 on the path along which the toilet paper is fed and facing a solenoid 90. In the event of a power outage the solenoid 90 pushes the toilet paper out of the dispenser through said slot 85, the paper being held by the guide 67. The paper is still accessible to the user, even in the event of a power outage.

The embodiment described hereinabove controls feeding of the paper automatically. It has an essential advantage in that the user can be sure of not using paper previously soiled, by the previous user, for example.

Consequently, the present invention provides a moistener device which can be disposed near an existing conventional toilet paper roll or integrated into a dispenser for hygiene items. The supply of water or other scented or medicated liquid of said moistener device is available in the form of a refill ready for use. It is inserted or replaced without it being necessary to remove the moistener device from the casing or from the dispenser. It is therefore easy to use and low in cost.

If the moistener device is integrated in a simple casing or in a dispenser of hygiene items it has the advantage of being replaceable in the event of a malfunction. In the electrically operated version, if any electrical unit should fail, all that is required is to pull the interchangeable electrical system 6 out of the support casing 21 or the dispenser 50 to cut off the power supply and then to replace it with a spare unit. There is therefore no requirement to call out skilled personnel to attempt to repair a specific component. This represents an important time and cost saving. This also shows the major advantage of the dispenser in accordance with the invention and its simple construction and use.

Of course, the invention is not limited to the embodiments described hereinabove to which modifications may be made without departing from the scope of the invention.

I claim:

1. Paper dispenser, more particularly toilet paper or sanitary towel dispenser, delivering either a wet or dry paper of the type comprising a casing having means through which paper can pass from inside to outside thereof, a paper moistener device comprising a refill (2) comprising a reservoir (3) fitted be forehand with a spray pump (4) and pump actuator means, characterized in that the actuator means is electrical and with the refill (2) constitute an interchangeable system, the spray pump engaged with the dispenser to effect a spray outside the casing.

2. Dispenser according to claim 1 characterized in that the interchangeable system (6) comprises a support frame (7) provided with a set of units connected to an electrical power supply and comprising a refill (2), an electric pump actuator member which operates on a lever (15) pivoting about an axis (16) and the arm (17) of which actuates the pump (4), and control means for the actuator device.

3. Dispenser according to claim 2 characterized in that the trigger means comprise a photo-electric cell disposed near the spray holes of the pump (4) to sense the hand of the user or the toilet paper or sanitary towel that the user is holding in front of the cell.

4. Dispenser according to claim 1 characterized in that the spray pump (4) is screwed onto the reservoir (3) to enable replacement of the refill (2) of the moistener device.

5. Dispenser according to claim 1 characterized in that the spray pump (4) is crimped to the reservoir (3) so that the reservoir (3) can be refilled.

6. Dispenser according to claim 1 characterized in that the moistener device is housed in a support frame (21) having a mobile wall (22).

7. Dispenser according to claim 1 characterized in that it comprises a casing (42) with a lid (45) at the front closing all or part of the casing (42) which includes a compartment adapted to receive a supply of toilet paper or other hygiene items.

8. Dispenser according to claim 7 characterized in that it comprises a central compartment (B) in which is disposed a moistener device (1) and two other compartments (A, C) one on each side of the central compartment and in that it has a lid (45) at the front closing off at least two adjoining compartments.

9. Paper dispenser, more particularly toilet paper or sanitary towel dispenser, of the type comprising a paper moistener device comprising a refill (2) comprising a reservoir (3) fitted beforehand with a spray pump (4) and pump actuator means, characterized in that the actuator means is electrical and with the refill (2) constitute an interchangeable system (6) comprising a support frame (7) provided with a set of units connected to an electrical power supply and comprising a refill (2), an electric pump actuator member which operates on a lever (15) pivoting about an axis (16) and the arm (17) of which actuates the pump (4), and control means for the actuator device, trigger means comprising a switch (30) disposed on a wall of the support frame (7) so that it is accessible to the user.

10. Dispenser according to claim 9 characterized in that the paper sensor (60) comprises a photo-electric cell connected to the paper guide and cutting system (61) in such a way as to command the feeding of the toilet paper on the guide plate (80).

11. Paper dispenser, more particularly toilet paper or sanitary towel dispenser, of the type comprising a paper moistener device comprising a refill (2) comprising a reservoir (3) fitted beforehand with a spray pump (4) and pump actuator means, characterized in that the actuator means is electrical and with the refill (2) constitute an interchangeable system (6) comprising a support frame (7) provided with a set of units connected to an electrical power supply and comprising a refill (2), an electric pump actuator member which operates on a lever (15) pivoting about an axis (16) and the arm (17) of which actuates the pump (4), and control means for the actuator device, the electric pump actuator member being a solenoid (12) operating the lever (15).

12. Paper dispenser, more particularly toilet paper or sanitary towel dispenser, of the type comprising a paper moistener device comprising a refill (2) comprising a reservoir (3) fitted beforehand with a spray pump (4) and pump actuator means, characterized in that the actuator means is electrical and with the refill (2) constitute an interchangeable system (6) comprising a support frame (7) provided with a set of units connected to an electrical power supply and comprising a refill (2), an electric pump actuator member which operates on a lever (15) pivoting about an axis (16) and the arm (17) of which actuates the pump (4), and control means for the actuator device, the electric pump actuator member being a motor-gear box (26) for operating the lever (15) by means of a cam (22) rotating on a shaft (24).

13. Paper dispenser, more particularly toilet paper or sanitary towel dispenser, of the type comprising a paper moistener device comprising a refill (2) comprising a reservoir (3) fitted beforehand with a spray pump (4) and pump actuator means, characterized in that the actuator means is electrical and with the refill (2) constitute an interchangeable system (6) comprising a support frame (7) provided with a set of units connected to an electrical power supply and comprising a refill (2), an electric pump actuator member which operates on a lever (15) pivoting about an axis (16) and the arm (17) of which actuates the pump (4), and control means for the actuator device, the movement of the lever (15) being damped by a damper system (20).

14. Paper dispenser, more particularly toilet paper or sanitary towel dispenser, of the type comprising a paper moistener device comprising a refill (2) comprising a reservoir (3) fitted beforehand with a spray pump (4) and pump actuator means, characterized in that the actuator means is electrical and with the refill (2) constitute an interchangeable system (6) comprising a support frame (7) provided with a set of units connected to an electrical power supply and comprising a refill (2), an electric pump actuator member which operates on a lever (15) pivoting about an axis (16) and the arm (17) of which actuates the pump (4), and control means for the actuator device, a wall of the support frame (7) of the moistener device being mobile to enable replacement of the refill (2).

15. Paper dispenser, more particularly toilet paper or sanitary towel dispenser, of the type comprising a paper moistener device comprising a refill (2) comprising a reservoir (3) fitted beforehand with a spray pump (4) and pump actuator means, characterized in that the actuator means is electrical and with the refill (2) constitute an interchangeable system (6) comprising a support frame (7) provided with a set of units connected to an electrical power supply and comprising a refill (2), an electric pump actuator member which operates on a lever (15) pivoting about an axis (16) and the arm (17) of which actuates the pump (4), and control means for the actuator device, the dispenser further comprising a lid (45) at the front of the casing (42) closing all or part of the casing (42) which includes a compartment adapted to receive a supply of toilet paper or other hygiene items, the casing (42) further comprising means for unwinding a roll of toilet paper automatically.

16. Dispenser according to claim 15 characterized in that the means for unwinding the toilet paper automatically comprises a paper guide and cutting system (61) disposed in a housing (62) under the compartment containing the supply of paper and a paper sensor (60) disposed opposite the paper guide and cutting system (61) at a distance substantially equal to the required length of toilet paper which is supported by a guide plate (80) disposed under the moistener device (1) between the paper guide and cutting system (61) and the paper sensor (60) and substantially perpendicular to the spray plane.

17. Dispenser according to claim 16 characterized in that the paper guide and cutting system (61) comprises adjacent upper and lower drums (66, 70) rotatable on respective shafts (68, 72) which are substantially parallel and mounted on a support (65) and between which the toilet paper is adapted to pass, a motor-gearbox (63) adapted to drive the upper drum (66) through a chain (64) when the paper sensor (60) senses the absence of paper in order to feed the toilet paper on the guide plate (80) and a paper cutter (75) for cutting the toilet paper, this set of units being disposed in the housing (62) to reduce the overall size and being connected to an electrical power supply.

* * * * *